US005571377A

United States Patent [19]

Tibbling et al.

[11] Patent Number: 5,571,377

[45] Date of Patent: Nov. 5, 1996

[54] PROCESS FOR PEROXIDE BLEACHING OF CHEMICAL PULP IN A PRESSURIZED BLEACH VESSEL

[75] Inventors: Petter Tibbling, Pilvägen 7; Ulla Ekström, Kappstad; Erik Nilsson, Ååtorp; Lars-Ove Larsson, Garvaregatan, all of Sweden

[73] Assignee: Kvaerner Pulping Technologies AB, Sweden

[21] Appl. No.: 244,637

[22] PCT Filed: Nov. 18, 1993

[86] PCT No.: PCT/SE93/00988

§ 371 Date: Jun. 7, 1994

§ 102(e) Date: Jun. 7, 1994

[87] PCT Pub. No.: W094/29511

PCT Pub. Date: Dec. 22, 1994

[30] Foreign Application Priority Data

Jun. 8, 1993 [SE] Sweden ..... 9301960-2

[51] Int. Cl.[6] ..... D21C 9/153; D21C 9/16

[52] U.S. Cl. ..... 162/52; 162/65; 162/76; 162/78

[58] Field of Search ..... 162/76, 65, 78, 162/233, 52, 57

[56] References Cited

U.S. PATENT DOCUMENTS

| | | | |
|---|---|---|---|
| 2,516,447 | 7/1950 | Burling et al. . | |
| 3,918,898 | 11/1975 | Katz | 162/78 |
| 4,244,778 | 1/1981 | Lindahl et al. | 162/57 |
| 4,410,397 | 10/1983 | Kempf | 162/65 |
| 4,427,490 | 1/1984 | Eckert . | |
| 4,568,420 | 2/1986 | Nonni | 162/65 |

(List continued on next page.)

FOREIGN PATENT DOCUMENTS

| | | |
|---|---|---|
| 641858 | 9/1993 | Australia . |
| 946107 | 4/1974 | Canada . |
| 1206704 | 7/1986 | Canada . |
| 2099827 | 7/1993 | Canada . |
| 0087553 | 7/1986 | European Pat. Off. . |
| A20206560 | 12/1986 | European Pat. Off. . |
| A20206560 | 12/1986 | European Pat. Off. . |
| 0433138 | 6/1991 | European Pat. Off. . |
| 0511695 | 4/1992 | European Pat. Off. . |

(List continued on next page.)

OTHER PUBLICATIONS

Singh, "The Bleaching of Pulp", Tappi Press; Atlanta, Georgia; pp. 608–609, 1979.

Decision Concerning Cancellation of Patent dated Feb. 28, 1996.

Lachenal, et al., "The Potential of $H_2O_2$as delignifying and bleaching agent application to new bleaching sequences, " 1992 Pan Pacific Pulps and Paper Conference Proceedings, Sep. 8–10, 1992, pp. 33–38.

(List continued on next page.)

*Primary Examiner*—Steven Alvo

*Attorney, Agent, or Firm*—Ronald P. Kananen

[57] ABSTRACT

A process for chlorine-free bleaching of chemical pulp in association with the production thereof, where a suspension of the pulp preferably has a concentration exceeding 8% of cellulose-containing fiber material and where the pulp entering into a bleaching line is preferably fed continuously through at least one bleaching vessel in the bleaching line, is treated with at least one acid for adjusting the pH to a value below 7, and with a chelating agent, and is subsequently bleached in at least one stage to a brightness exceeding 75% ISO, preferably exceeding 80%, with hydrogen peroxide or the corresponding quantity of another peroxide, employed in a quantity exceeding 5 kg/BDMT, where the peroxide bleaching takes place at elevated temperature and at a pressure in the bleaching vessel which exceeds 2 bar and where the cross-sectional area of the bleaching vessel exceeds 3 $m^2$ and the area of the metal surface exposed towards the interior of the bleaching vessel is less than 4 V $m^2$, where V indicates the volume in $m^3$.

49 Claims, 14 Drawing Sheets

U.S. PATENT DOCUMENTS

| | | | |
|---|---|---|---|
| 4,734,160 | 3/1988 | Moldenius | 162/78 |
| 4,756,798 | 7/1988 | Lachenal et al. | 162/65 |
| 4,804,440 | 2/1989 | Liebergott et al. | 162/70 |
| 5,133,946 | 7/1992 | Schwarzl . | |
| 5,171,405 | 12/1992 | Torregrossa . | |
| 5,192,397 | 3/1993 | Bohman . | |
| 5,266,160 | 11/1993 | Hencrison et al. . | |
| 5,296,099 | 3/1994 | Griggs et al. | 162/65 |
| 5,296,100 | 3/1994 | Devic et al. . | |
| 5,310,458 | 5/1994 | Lundgren et al. | 162/78 |

FOREIGN PATENT DOCUMENTS

| | | |
|---|---|---|
| A10512590 | 11/1992 | European Pat. Off. . |
| A10512590 | 11/1992 | European Pat. Off. . |
| 0456626 | 4/1993 | European Pat. Off. . |
| 0402335 | 11/1993 | European Pat. Off. . |
| 56134362 | 5/1981 | Japan . |
| 469842 | 9/1993 | Sweden . |
| 1056126 | 1/1967 | United Kingdom . |
| W09212289 | 7/1992 | WIPO . |
| W09212289 | 7/1992 | WIPO . |
| W09300470 | 1/1993 | WIPO . |
| W09314262 | 7/1993 | WIPO . |
| W09316227 | 8/1993 | WIPO . |
| W09323607 | 11/1993 | WIPO . |
| W09411569 | 5/1994 | WIPO . |
| W09411568 | 5/1994 | WIPO . |
| W09410374 | 5/1994 | WIPO . |
| W09412721 | 6/1994 | WIPO . |
| 9400556 | 6/1994 | WIPO . |

OTHER PUBLICATIONS

Official Gazette, vol. 1038, No. 4: Delignification and Bleaching Process for Lignocellulosis . . . of Metal Additives Abstract of U.S. Patent No. 4,427,490.

Alfthan, Carl–Johan, et al., "High–Temperature Peroxide Bleaching of Sulphate Pulp", Svensk Papperstidning (Ar 15 1977).

OZP–Bleaching of Kraft Pulps to Full Brightness (U. Germgåard and S. Nordén) Sunds Defibrator.

"A Train of Developments Towards Chlorine Chemical Free Manufacturing of Bleached Kraft Pulps" K. Kovasin; L. Lindstrom, L. Sjodin (date unknown) .

"Mill Experiences of LIGNOX Bleaching" L. Igerud (date unknown).

Current State–of –the–Art of EO, EP and EPO Technologies: Non–chlorine bleaching conference, Mar. 1992, Hilton Head, SC, U.S.A.

A Handbook About Hydrogen Peroxide and How it Should be Handled–Eka Nobel Inc. 1991.

Delignification using hydrogen peroxide and oxygen under acidic conditions–the –POs–treatment–1985 Wood and Pulping Chemistry Symposium.

Degradation of carbonhydrates during oxygen bleaching, O. Samuelson and L. Stolpe, Chalmers University of Technology, Dept. of Engineering.

Semibleaching of kraft pulp using oxygen and hydrogen peroxide, H. U. Süss, W. Eul and O. Helming.

Proceedings–1991 Pulping Conference Book 1.

Production of Bleached Chemical Pulp in the Future–International Pulp Bleaching Conference 1991, Stockholm, Sweden Jun. 11–14, 1991 (vol. 3).

Non–Chlorine Bleaching Conference Proceedings–Emerging Technology Transfer Inc. (Pulp & Paper).

Improvement of Hydrogen Peroxide Delignification–Centre Technique du Papier–Forest Research Institute (1987).

Svensk Papperstidning–Swedish Paper Journal Nr. 18, Dec. 15, 1988 (w/translation).

High–temperature peroxide bleaching of sulphate pulp, Carl–Johan Alfthan et al, Swedish Forest Products Research Laboratory, Stockholm, Svensk Paperstidning Nr. 15, 1977.

Bleaching Technology, D. W. Reeve, Pulp and Paper Manufacture, vol. 5, 1989.

Proceedings–Emerging Technologies Today and in the Future Mar. 2–5 1992 Westin Resort–Hilton Head–South Carolina.

Modern Bleaching Technology, Kaj Henricson, Ahlstrom Machinery–Non–Chlorine Bleaching Conference 1993.

The Bleaching of Pulp, Third Edition, Revised–Pulp Manufacturer Division.

Pulping Processes, Sven A. Rydholm, 1965, Interscience Publishers.

Official Gazette, vol. 1038, No. 4: Delignification and Bleaching Process for Lignocellulosic . . . of Metal Additives Abstract of U.S. Pat. No 4,427,490..

The plants become larger and larger, Svenk Papperstidning Nr. 10, 1989 (translation).

Svenk Paperstidning–Nordisk Cellulose Nr. 18, Dec. 6, 1990 (translation).

PROCESS FOR PEROXIDE BLEACHING OF CHEMICAL PULP IN A PRESSURIZED BLEACH VESSEL

The invention relates to a process for chlorine-free bleaching of chemical pulp in association with production of the same, in which a suspension of the pulp preferably has a consistency exceeding 8% of cellulose-containing fibre material and in which the pulp entering into a bleaching line is preferably fed continuously through at least one bleaching vessel in the bleaching line, is treated with at least one acid for adjusting the pH to a value below 7 and with a chelating agent, and is subsequently bleached in at least one stage to a brightness exceeding 75% ISO, preferably exceeding 80%, using hydrogen peroxide or a corresponding quantity of another peroxide, added in a quantity exceeding 5 kg/BDMT.

Marketing and environmental considerations have demanded that extensive efforts be made to eliminate the use of chlorine-containing compounds for bleaching purposes. Using current technology, it is difficult to achieve complete bleaching of paper pulp prepared from soft wood sulphate pulp using oxygen, hydrogen peroxide and ozone.

There are a number of peroxide beaching processes of the Lignox and Macrox type in which a combination of EDTA treatment and peroxide addition is used. These processes require a minimum of a 4-hour reaction time at 90° C. and, despite this, it is found that when a successful bleaching of oxygen-delignified softwood pulp has been carried out, with the pulp having a kappa of 12 and with a brightness of 77–79 ISO having been achieved, about half of the quantity of peroxide employed remains unused. The intention is that the latter should subsequently be returned to the process for reuse after the addition of fresh peroxide. As far as we know, this still does not take place on a factory scale. In some cases, the peroxide is returned to the oxygen reactor, with any possible brightness-increasing effect being negligible.

Through the Swedish Patent Application, laid open, 8503153-2 (Wagner-Biró AG), a process is known for delignifying pulp using oxygen and/or ozone with the possible addition of peroxide. In the said process, the pulp is placed in contact with oxygen, possibly in the presence of peroxide, at a temperature of 80° C. to 150° C. An alkalising supplement is then added to the pulp. The process can be repeated in several stages with increasing pressures and/or temperatures. This process is based on a two-stage process where the first stage takes place, in this case, at a consistency of 2.5–4.5% and the second stage is carried out at a consistency of 10%. The quantity of peroxide employed is 0–5 kg of $H_2O_2$ per kg of ptp.

An approach which might seem to present itself immediately would be to raise the temperature and apply pressure in order to shorten the necessary reaction time and/or decrease the peroxide residue in order to achieve optimal utilisation of the hydrogen peroxide employed, and this suggestion is in fact included as a possibility in the Swedish Patent 8902058-0 (EKA Nobel AB) in which the so-called Lignox process is described. Experiments in this direction have been carried out, but have failed, the results in all respects being worse than those achieved with purely atmospheric peroxide bleaching. It has even been suggested that oxygen is of no value in bleaching by the Lignox method. The application of pressure is preferably carried out using an MC pump, with the pumped suspension having a consistency exceeding 8% and preferably less than 18%.

It should be noted that experiments to which reference has been made in the patent and other literature have, for understandable reasons, been carried out on a laboratory scale. Indications have been obtained that the results are worse if the temperature is increased (for example from 90° C. to 95° C.) and the conclusion has been drawn that peroxide bleaching should preferably take place at a temperature below 90° C.

The object of the present invention is to produce a process of the type mentioned in the introduction which provides efficient and more homogeneous bleaching.

This is achieved, according to the invention, by the peroxide bleaching taking place at elevated temperature and at a pressure in the bleaching vessel which exceeds 2 bar, by the cross-sectional area of the bleaching vessel exceeding 3 $m^2$, and by the area of the metal surface exposed towards the interior of the bleaching vessel being less than 4 V $m^2$, where V indicates the volume in $m^3$.

It can be added that, in laboratory bleachings, plastic bags are used under conditions of atmospheric pressure in a waterbath whose temperature is maximally 90° C.–95° C. For obvious reasons, pressurised procedures in a gas atmosphere are carried out in acid-resistant autoclaves.

It has now emerged, surprisingly, that the hot metal surface of the autoclave catalyses decomposition of the peroxide. Brightness, kappa number and viscosity all reach improved values in association with lower consumption of peroxide if the pulp and the peroxide are placed together in a sealed plastic bag before the bag is put into the autoclave which is filled with water for heat transfer between the autoclave and the bag. Experiments have been carried out both with and without the application of an extra (5 bar) oxygen pressure. Without entirely espousing a particular theory, it can be supposed that a plausible mechanism for this could be that the hot metal surfaces of the autoclave catalyse decomposition of the peroxide. To investigate this, the experiments described below, inter alia, were carried out. These experiments demonstrated that our assumption was correct. Since the quantity of inwardly exposed metal surface per unit of volume in a vessel decreases quadratically with regard to the increase in volume of the vessel, we have been able to conclude that the above-mentioned problem is laboratory-specific, i.e. at a particular value of the cross-sectional area of the bleaching vessel (circa 3 $m^2$, which effect consequently decreases further with increased cross-sectional area~D) this effect is marginal.

It has also emerged surprisingly that a further improve of the process according to the invention is obtained by using a complexing agent which is capable of withstanding higher pH values without being broken down. With higher pH values is meant values up to 11.

It is know within the state of the art to wash the pulp suspension after the complexing agent, e.g. EDTA, has been added in the Q stage, in order first to bind and then to wash out the transition elements present in the pulp suspension. A certain amount of the metal bound by the EDTA, however, will remain in the suspension and be carried over into the next stage. Moreover, there may still be metal not bound by the EDTA which also remains.

At the pH values existing in the next stage it appears that the metals complexly bound by EDTA will be freed since EDTA does not withstand the pH values used in the bleaching stage. The freed metal ions, as well as those never bound, have a detrimental effect on the continued process since they decompose the peroxide used in the bleaching.

Thus it has proved to be an improvement to the process according to the invention, after the Q-stage, preferably together with the peroxide, to add an amount of a complexing agent, which is capable of withstanding high pH-values without decomposition. By this addition the disadvantages referred to above will be removed. According to the invention a preferred complexing agent is DTPA.

It has also emerged that a further improvement of the process according to the invention is obtained by supplying oxygen, in conjunction with the bleaching, in a quantity which is less than 5 kg/BDMT, preferably less than 3 kg/BDMT and more preferably less than 1 kg/BDMT. It has also been found that nitrogen can be used instead of oxygen, resulting in only a small increase in the consumption of peroxide.

According to a further aspect of the invention, the process is improved by the temperature during the bleaching exceeding 90° C., preferably equalling or exceeding 100° C., and more preferably being between 100° C. and 105° C.

According to a further aspect of the invention, the process is improved by the quantity of peroxide employed exceeding 10 kg/BDMT and being less than 35 kg/BDMT in order to achieve a brightness exceeding 85 ISO.

According to a further aspect of the invention, the process is improved by the pressure exceeding 3 bar, preferably being within the interval 5 to 15 bar and more preferably within the interval 5 to 10 bar.

According to a further aspect of the invention, the process is improved by the pulp, during the bleaching, not being permitted to any significant extent to come into contact with metal surfaces, with preferably at least the inner surface of the bleaching vessel being made of some polymeric or ceramic material.

According to a further aspect of the invention, the process is improved by the Q stage being preceded by a Z stage or by a peracetic acid stage and by a brightness exceeding 85 ISO being obtained with the aid of such a 2-stage process in association with a consumption of peroxide which is less than 20 kg/BDMT.

According to a further aspect of the invention, the process is improved by no washing taking place between ZQ, and preferably by an A stage preceding the Z stage.

According to a further aspect of the invention, the manganese content should be less than 5 g/BDMT of pulp, preferably less than 1 g/BDMT of pulp, and more preferably less than 0.5 g/BDMT of pulp, in the pulp for the peroxide stage, which is largely the same as the content in the finally bleached pulp.

According to a further aspect of the invention, the process is improved by, at the bleaching stage, a pH-elevating agent first being added to the pulp suspension prior to the peroxide being mixed in at a temperature of less than 90° C., before the temperature is finally raised to the desired level for carrying out the bleaching itself.

According to a further aspect of the invention, the process is improved by, at addition of the pH-elevating agent to the pulp suspension in the bleaching stage preceeding the addition of the peroxide, the initial pH-value not being raised higher than 11.5, preferably the pH-value is adjusted to a value between 10 and 11.

According to a further aspect of the invention, the process is improved by at least one complexing agent participating in the peroxide bleaching stage, which complexing agent preferably is added to the suspension together with the peroxide.

According to a further aspect of the invention, the process is improved by one of the at least one complexing agents being one, which substantially withstands a pH-value up to 11, this complexing agent preferably being DTPA.

According to a further aspect of the invention, the process is improved by the complexing agent DTPA being added in an amount preferably between 1 and 2 kg DTPA/ADMT.

According to a further aspect of the invention, the process is improved by the positive pressure in the bleaching vessel being obtained with the aid of a centrifugal pump, a so-called MC pump.

According to a further aspect of the invention, the process is improved by the peroxide bleaching being carried out hydraulically, with no gas phase being present in the bleaching vessel.

According to a further aspect of the invention, the process is improved by the diameter of the bleaching vessel exceeding 3 meters, preferably 5 meters and more preferably 7 meters.

The examples below illustrate the invention and demonstrate the surprising and unexpected result.

BRIEF DESCRIPTION OF THE DRAWINGS

In conjunction with the description below, reference is also made to the accompanying diagrams where.

COMPARITIVE EXAMPLES

Figure 1:
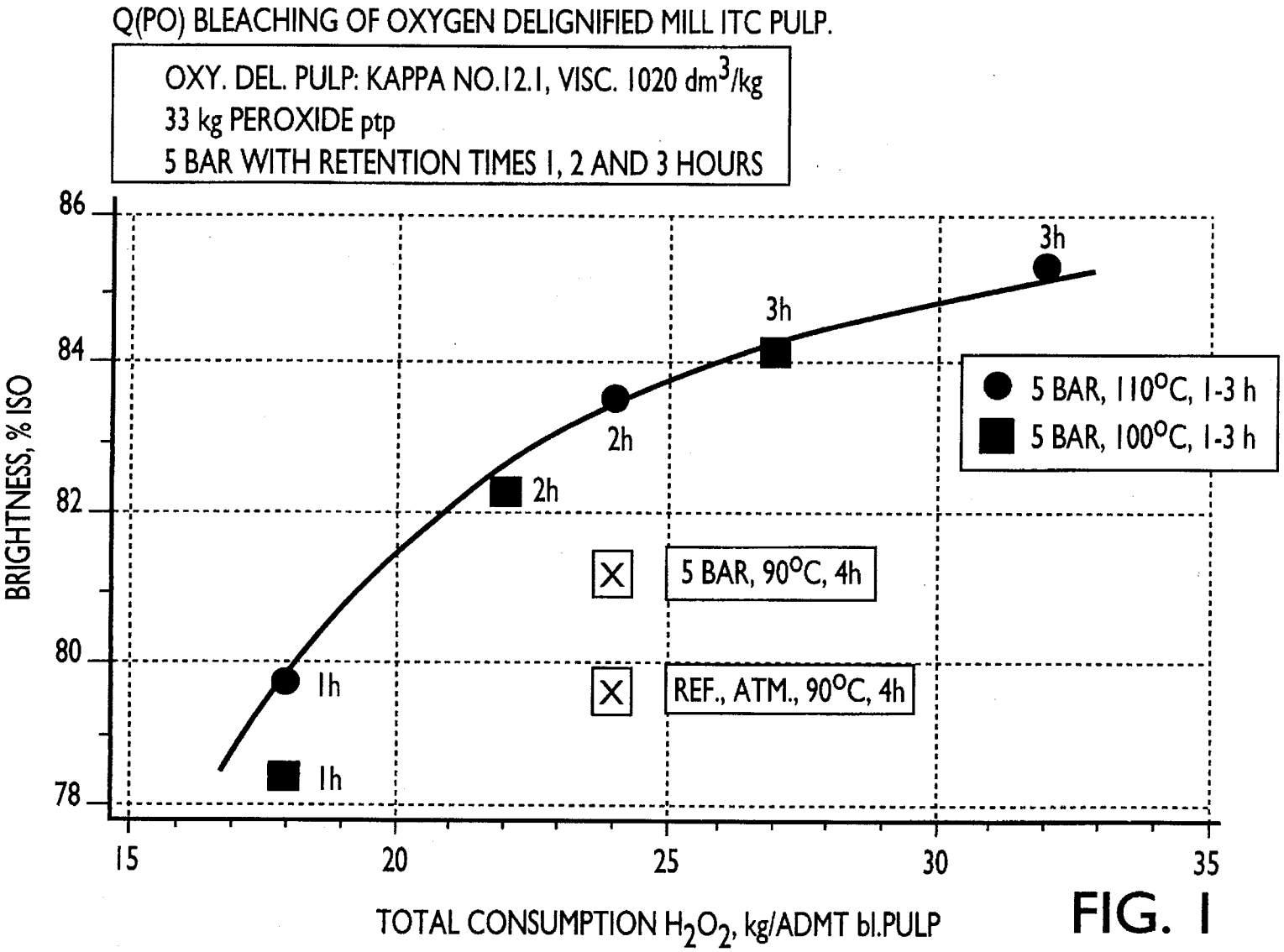
FIG. 1. shows a diagram of the relationship, during bleaching according to the invention, between brightness, % ISO and total consumption of $H_2O_2$ kg/ADMT, at either 5 bar and 100° C. or 5 bar and 110° C. for 1, 2 and 3 hours, and at 90° C., 0 bar and 4 hours, and at 90° C., 5 bar and 4 hours.

Q(Pressurised P)-bleaching of oxygen-delignified soft wood pulp

In order to demonstrate the effect of, on the one hand, the difference from pulp suspension which is bleached in direct contact with metal surfaces in the bleaching vessel and of, on the other hand, the effect of applying a pressure, as well as indirectly the effect of raising the temperature during the process, since when the autoclaves are filled with water round the plastic bags a much improved heat transfer to the pulp suspension is obtained, the following experiments were carried out.

A pulp with a kappa number of 12.1, a consistency of 10% and a viscosity of 1020 $dm^3/kg$, was treated with EDTA in a Q stage, temperature 70° C., initial pH ($H_2SO_4$) 4.7 and a final pH equal to 5.0. The pulp treated in this way was subsequently subjected to an EOP stage at a consistency of 10% and during a period of 240 min and at the temperature of 90° C. This stage was carried out under normal pressure column a, b and c, as well as with 5 bar of positive pressure (oxygen atmosphere). The result is shown in the table below.

TABLE I

| | a | b | c | d | e | f |
|---|---|---|---|---|---|---|
| Consistency, % | | | 10 | | | |
| Temperature, °C. | | | 90 | | | |
| Time, minutes | | | 240 | | | |
| | * | ** | **** | * | ** | *** |
| Average pressure, bar (excess) | 0 | 0 | 0 | 5 | 5 | 5 |
| $MgSO_4$, kg/BDMT | 3 | 3 | 3 | 3 | 3 | 3 |
| $H_2O_2$, kg/BDMT | 35 | 35 | 35 | 35 | 35 | 35 |
| NaOH, kg/BDMT | 25 | 25 | 25 | 25 | 25 | 25 |
| Consumption of $H_2O_2$, kg/BDMT | 33.0 | 26.4 | 25.7 | 33.3 | 23.7 | 25.3 |
| Final pH | 11.2 | 10.9 | 10.9 | 11.1 | 10.8 | 10.8 |
| Kappa number | 4.8 | 4.7 | 4.6 | 4.5 | 4.3 | 4.2 |
| Viscosity, $dm^3/kg$ | 746 | 849 | 828 | 802 | 838 | 837 |

TABLE I-continued

| | a | b | c | d | e | f |
|---|---|---|---|---|---|---|
| Brightness, % ISO | 77.9 | 78.5 | 79.7 | 79.7 | 80.7 | 81.6 |
| Quantity of peroxide employed, kg/ADMT | 33 | 33 | 33 | 33 | 33 | 33 |
| Consumption of peroxide, kg/ADMT | 31 | 25 | 24 | 31 | 22 | 24 |

*in autoclaves with direct contact with the metal
**sealed in plastic bags and introduced into the autoclaves
***sealed in plastic bags and introduced into the autoclaves filled with water for improved heat transfer It can be seen from Table I that the absence of contact between the pulp suspension and the metal surfaces directly affects the consumption of $H_2O_2$ and that the latter is also affected by the supply of heat to the pulp suspension, which can be seen from a comparison between columns b and c.

It is evident from Table 1 that the application of oxygen pressure (5 bar) improves the brightness by two units and gives better selectivity and a kappa reduction, which can be seen from the above table by comparing columns c and f.

Increasing the temperature by 10° C. from 90° C. to 100° C. approximately halves the reaction time required to achieve the same final brightness when using the same loading. This is shown in further experiments on the same pulp as in the above experiments. In this case all the experiments were carried out using an applied oxygen pressure of 5 bar. The experimental parameters and results are recorded in Table II below. By comparing I:f with II:e the temperature effect can be demonstrated.

TABLE II

| | a | b | c | d | e | f |
|---|---|---|---|---|---|---|
| Consistency, % | | | | 10 | | |
| Temperature, °C. | | | | 100 | | |
| Time, minutes | 60 | 120 | 180 | 60 | 120 | 180 |
| Average pressure, bar (excess) | 5 | 5 | 5 | 5 | 5 | 5 |
| $MgSO_4$, kg/BDMT | 3 | 3 | 3 | 3 | 3 | 3 |
| $H_2O_2$, kg/BDMT | 25 | 25 | 25 | 35 | 35 | 35 |
| NaOH, kg/BDMT | 24 | 24 | 24 | 25 | 25 | 25 |
| Consumption of $H_2O_2$, kg/BDMT | 12.2 | 16.0 | 19.1 | 16.4 | 21.4 | 26.0 |
| Final pH | 10.8 | 10.6 | 10.4 | 10.7 | 10.5 | 10.4 |
| Kappa number | 5.3 | 4.6 | 4.2 | 5.0 | 4.3 | 4.0 |
| Viscosity, $dm^3/kg$ | 906 | 829 | 803 | 896 | 827 | 790 |
| Brightness, % ISO | 73.8 | 79.6 | 81.4 | 76.9 | 81.3 | 83.1 |
| Quantity of peroxide employed, kg/ADMT | 23 | 23 | 23 | 33 | 33 | 33 |
| Consumption of peroxide, kg/ADMT | 11 | 15 | 18 | 15 | 20 | 24 |

From the above Table II, it can also be seen that lowering the quantity of peroxide employed from 35 to 25 kg ptp (2/3) increases the reaction time which is required to achieve a brightness of 81.4 ISO from 2 to 3 hours, i.e. by lengthening the reaction time an economy can be achieved in the quantity of peroxide employed.

From a comparison between Table II:e and Table II:c it can be seen that lowering the quantity of peroxide employed from 35 to 25 kg ptp (to 2/3) increases the reaction time necessary for achieving a brightness of 81.4 ISO from 2 hours to 3 hours.

Comparative experiments at different temperatures.

TABLE III

| | a | b | c | d | e |
|---|---|---|---|---|---|
| Consistency, % | | 10 | | | |
| Temperature, °C. | 90 | 90 | 100 | 100 | 110 |
| Time, minutes | | | 240 | | |
| Average pressure, bar (excess) | 0 | 5 | 0 | 5 | 5 |
| $MgSO_4$, kg/BDMT | 3 | 3 | 3 | 3 | 3 |
| $H_2O_2$, kg/BDMT | 35 | 35 | 35 | 35 | 35 |
| NaOH, kg/BDMT | 30 | 30 | 30 | 30 | 30 |
| Consumption of $H_2O_2$, kg/BDMT | 33.0 | 31.1 | 34.8 | 34.9 | 34.9 |
| Final pH | 11.4 | 11.3 | 11.1 | 11.3 | 10.0 |
| Kappa number | 4.6 | 4.4 | 4.4 | 3.5 | 3.9 |
| Viscosity, $dm^3$/kg | 707 | 733 | 660 | 685 | 675 |
| Brightness, % ISO | 77.4 | 81.4 | 76.4 | 80.6 | 80.8 |
| Quantity of peroxide employed, kg/ADMT | 33 | 33 | 33 | 33 | 33 |
| Consumption of peroxide, kg/ADMT | 31 | 29 | 32 | 32 | 32 |

in autoclaves with direct contact with the metal
note the effect of oxygen pressure In addition to this, further experiments have been carried out on the same pulp at oxygen pressures of 0–10 bar in order to demonstrate the importance of the temperature in combination with the oxygen pressure.

From the graph shown in FIG. 1, it can be seen, inter alia, that a Q(pressurised P)-sequence at 110° C. and 5 bar decreases the necessary reaction time from 4 hours to 1 hour as compared with that which is required under conventional atmospheric conditions at 90° C. In addition, the peroxide consumption which is necessary decreases by 25% to 18 kg ptp.

Figure 2:
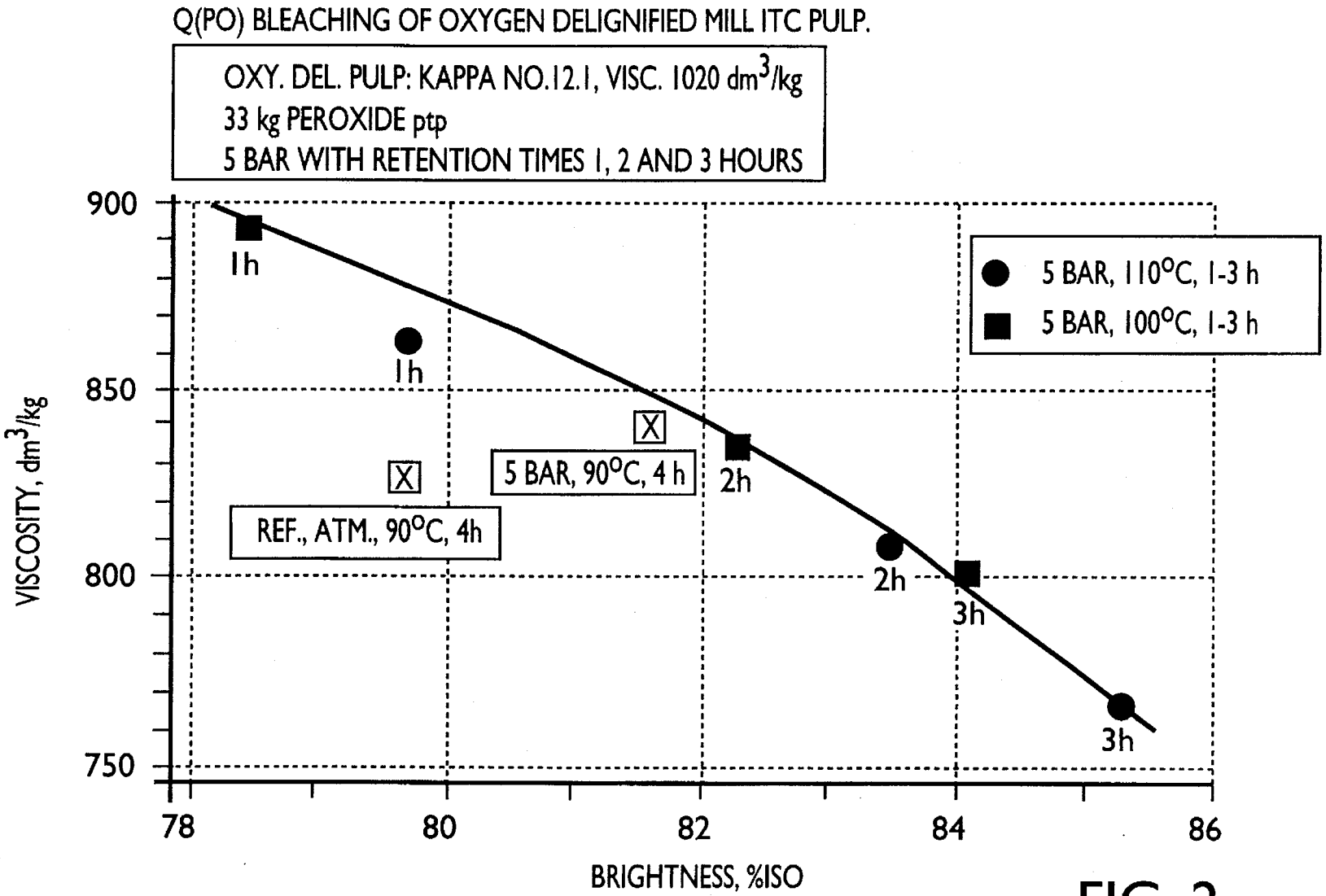
FIG. 2. shows a diagram of the relationship, during bleaching according to the invention, between brightness % ISO and viscosity, $dm^3$/kg, at either 5 bar and 100° C. or 5 bar and 110° C. for 1, 2 and 3 hours, and at 90° C., 0 bar and 4 hours, and at 90° C., 5 bar and 4 hours.

From the graph in FIG. 2 it can be seen, inter alia, that simply applying oxygen pressure at 90° C. increases the brightness by 2 steps from ~80 to ~82.

It has now emerged that there is a possibility of dividing the pressurised-P stage into two stages, with the first part of the process taking place, for example, at a lower temperature of 80°–90° C. under atmospheric pressure and the second part taking place under applied oxygen pressure at 110°–120° C., once the content of peroxide present in the pulp has declined.

Figure 3:
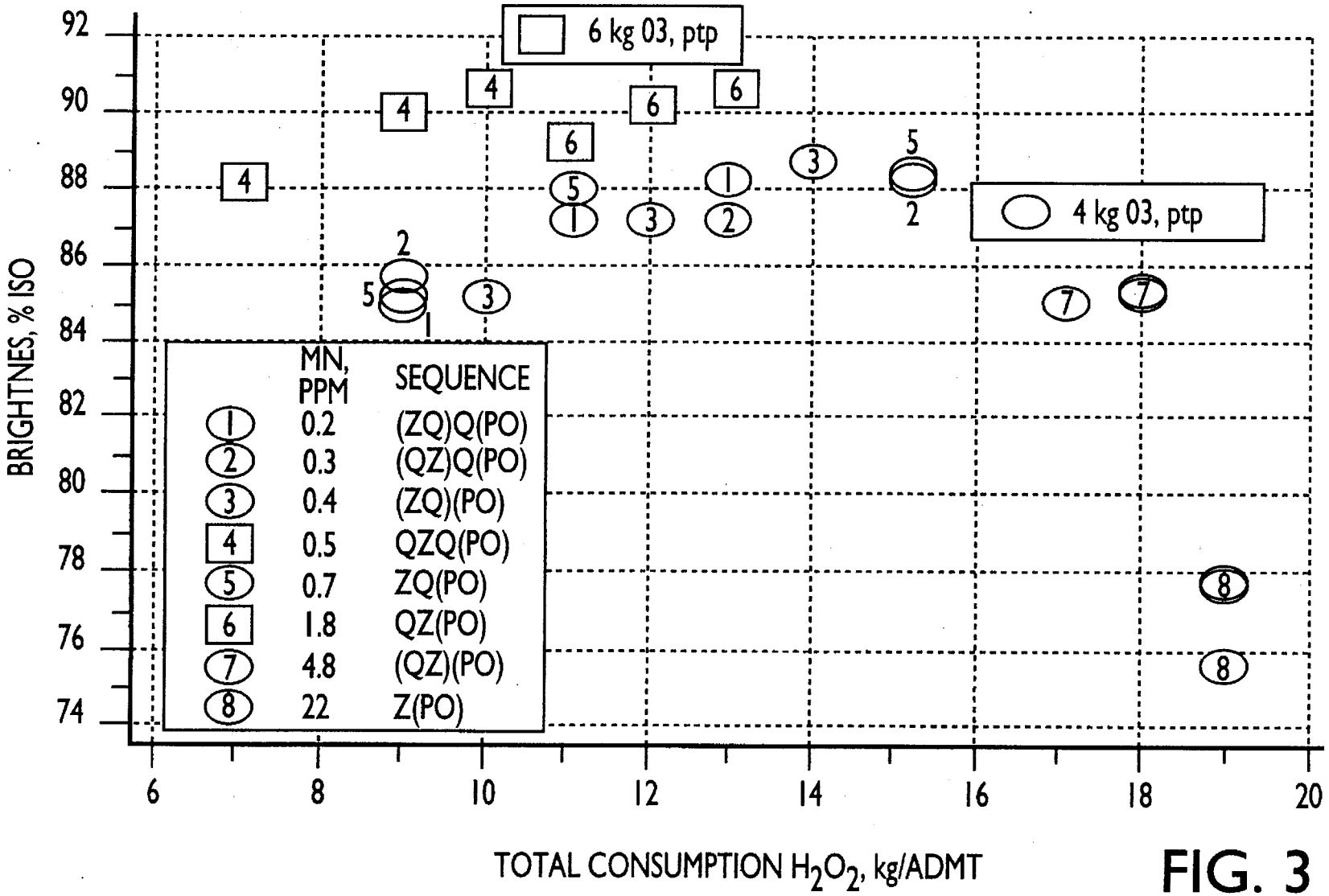
FIG. 3. shows a diagram of the relationship between brightness, % ISO, and total consumption of $H_2O_2$, kg/ADMT, during bleaching with a pressurised P stage according to the invention inserted in different bleaching sequences and with an ozone stage at 50° C. including a pressure of 6 kg or 4 kg and varying quantities of manganese.
Figure 4:
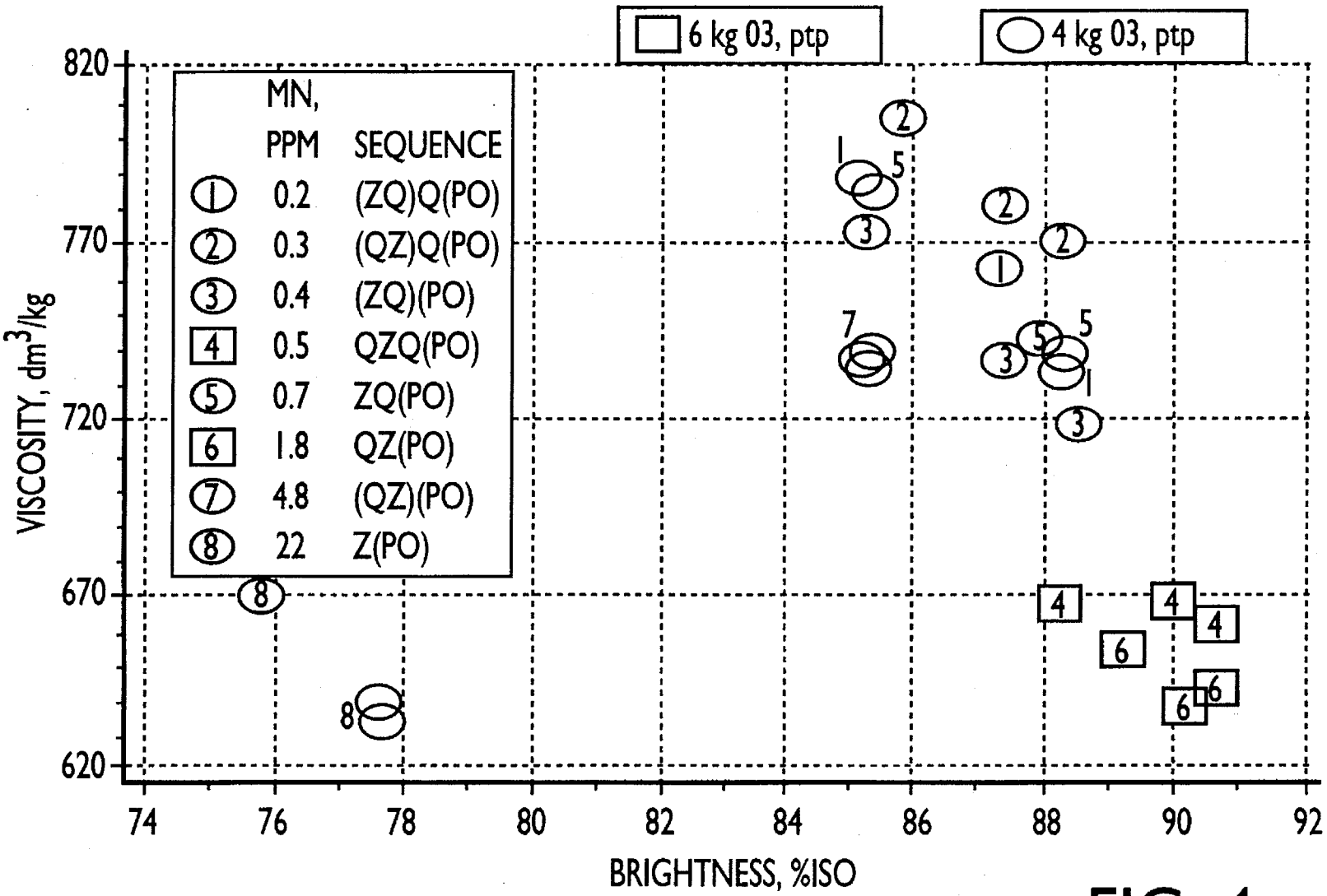
FIG. 4. shows a diagram (the same experimental series) of the relationship between brightness, % ISO, and viscosity, $dm^3$/kg, during bleaching with a pressurised P stage according to the invention inserted in different bleaching sequences and with an ozone stage at 50° C. including a pressure of 6 kg or 4 kg and varying quantities of manganese.

The importance of a Q treatment prior to a peroxide stage is already well known. If ozone is combined with the pressurised P stage, a simple 2-stage sequence can be used to produce marketable pulp of full brightness (88–90 ISO) and with good strength properties. See FIG. 3, where the total consumption of hydrogen peroxide has been related to the brightness in % ISO, and FIG. 4., where the viscosity has been related to the brightness in % ISO. The correlation between Mn content, brightness and hydrogen peroxide consumption or viscosity for a number of different sequences can clearly be seen in these graphs. As is evident from the sequence ZQ, the sequence ozone followed by a Q stage together with alkali, pH 5–6, without interpolated washing is consequently favourable for producing a low manganese content and good results.

The importance of the presence of manganese for peroxide consumption and pulp viscosity has been found to be crucial. Our experiments have demonstrated that every additional gram of manganese/BDMT of pulp increases the peroxide consumption by 2 kg/BDTM and lowers the quality of the pulp by 10 to 20 units in the SCAN viscosity ($dm^3$/kg). The degree of washing must exceed 95%, preferably 99%, in order to achieve these low manganese contents. It is best to use one or more, or a combination of, KAMYR atmospheric diffusers, KAMYR pressure diffusers or KAMYR washing presses in the bleaching line.

Figure 5:
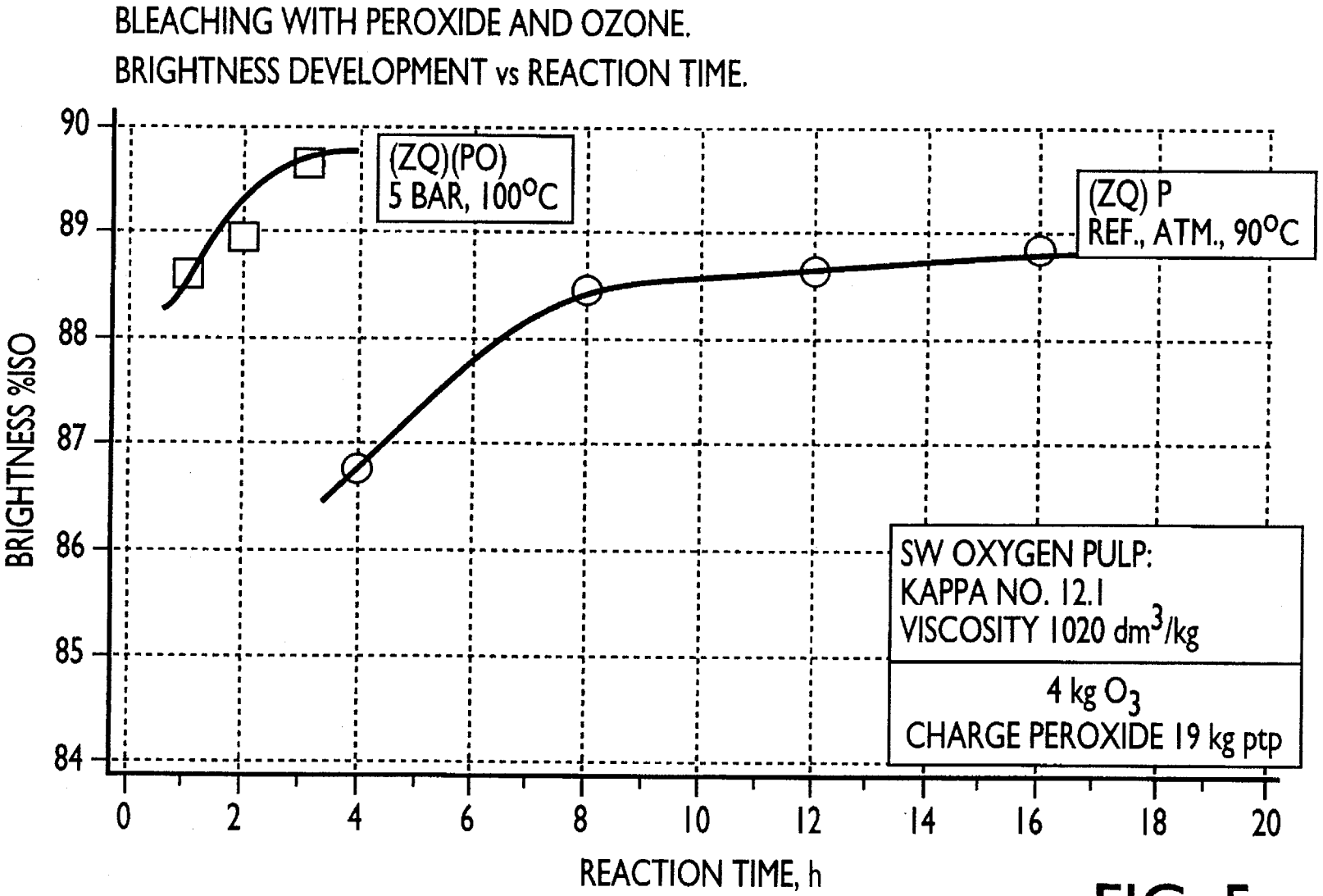
FIG. 5. shows a diagram of the relationship between brightness, % ISO, and reaction time for a bleaching sequence with a pressurised (PO) stage after a (QZ) stage according to the invention and a sequence for comparison at atmospheric pressure and 90° C.
Figure 6:
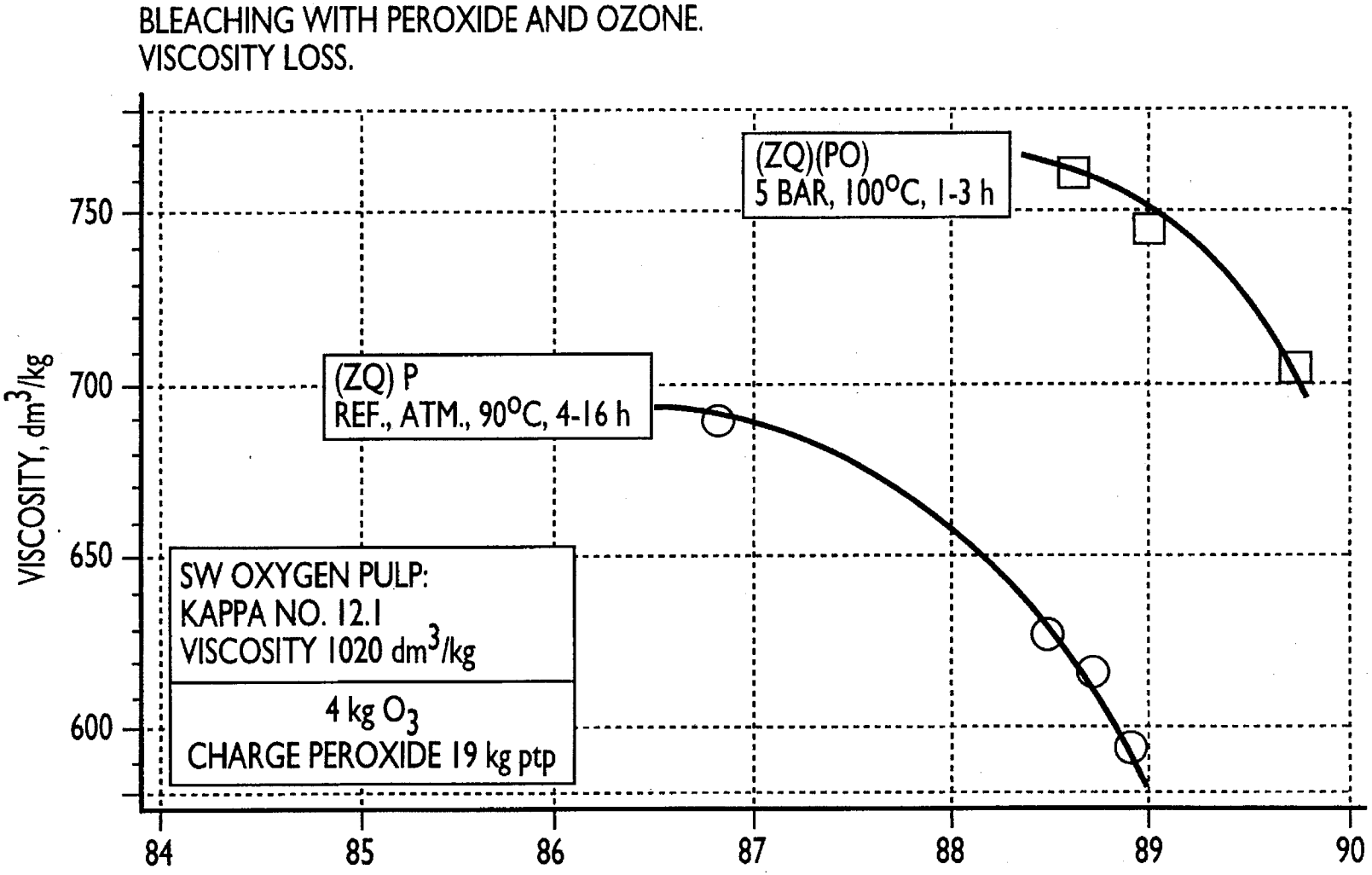
FIG. 6. shows a diagram of the relationship between brightness, % ISO, and viscosity, $dm^3$/kg, for the bleaching sequence in FIG. 5. according to the invention and a sequence for comparison at atmospheric pressure and 90° C.
Figure 7:
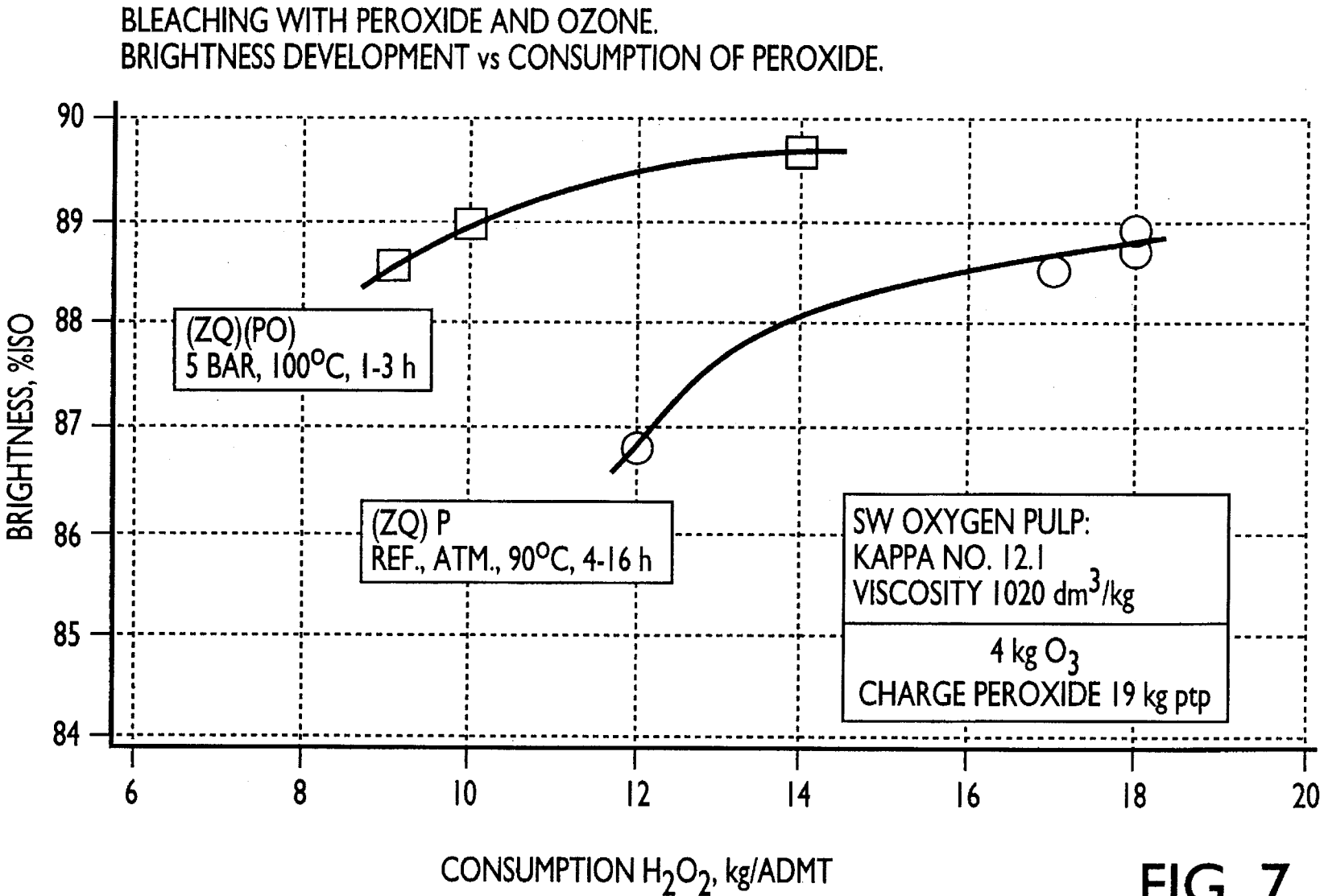
FIG. 7. shows a diagram of the relationship between brightness, % ISO, and total consumption of $H_2O_2$, kg/ADMT, for the bleaching sequence in FIG. 5. according to the invention and a sequence for comparison at atmospheric pressure at 90° C.

The appreciable advantages of having the pressurised (PO) stage after a (ZQ) stage, compared with conventional technology under atmospheric pressure, are evident from the graph in FIG. 5, where a decreased reaction time can be observed, from the graph in FIG. 6, where the process using a pressurised bleaching with peroxide and ozone leads to appreciably lower loss of viscosity, i.e. results in the achievement of higher pulp viscosity and higher brightness in relation to the reference experiment, and from the graph in FIG. 7 which demonstrates that, to achieve a brightness of 88–89% ISO according to the invention, the consumption of peroxide is halved as compared with reference experiments carried out under atmospheric pressure.

Figure 8:
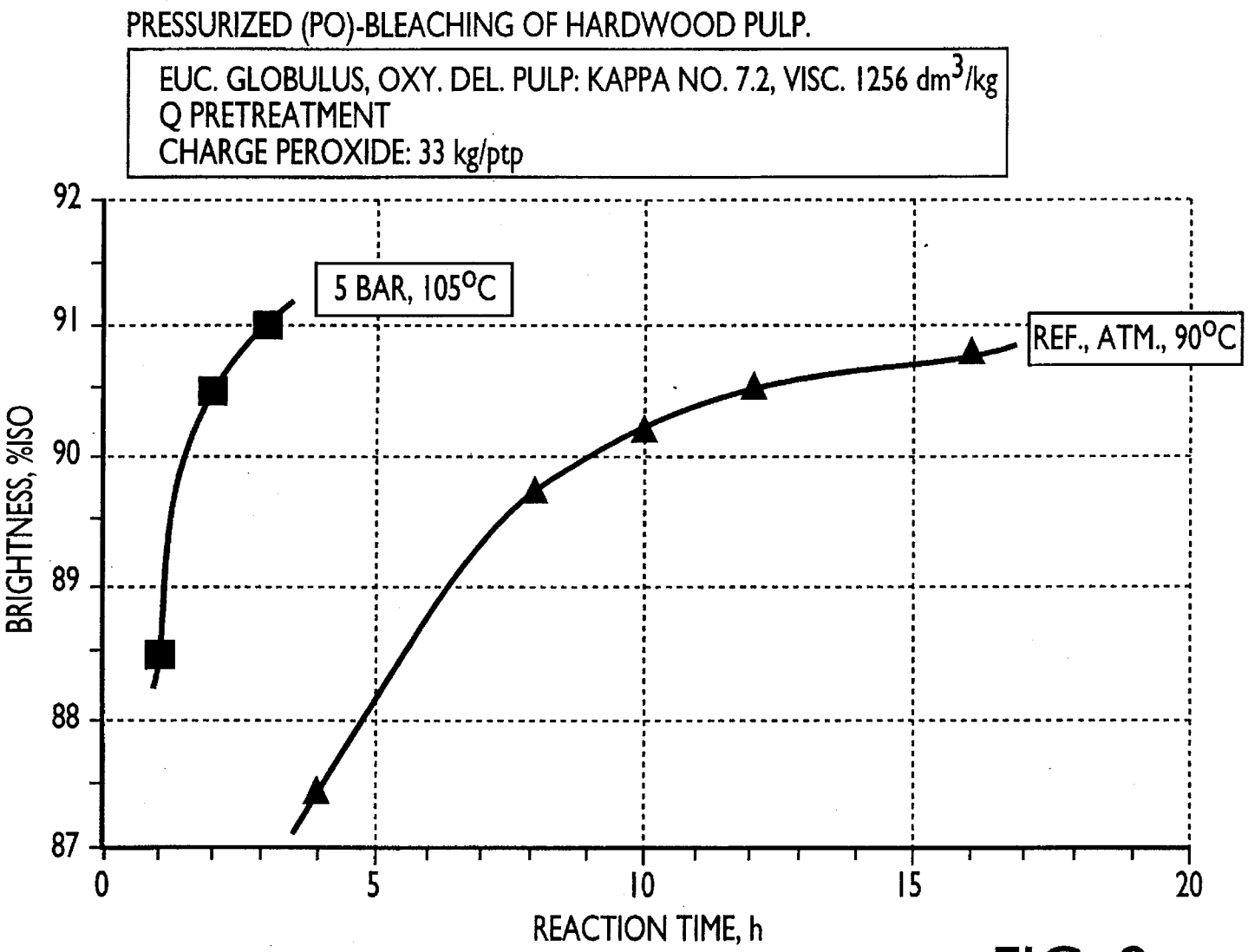
FIG. 8. shows a diagram of the relationship between brightness, % ISO, and reaction time for a bleaching sequence with a pressurised (PO) stage according to the invention and a sequence for comparison at atmospheric pressure and 90° C.
Figure 9:
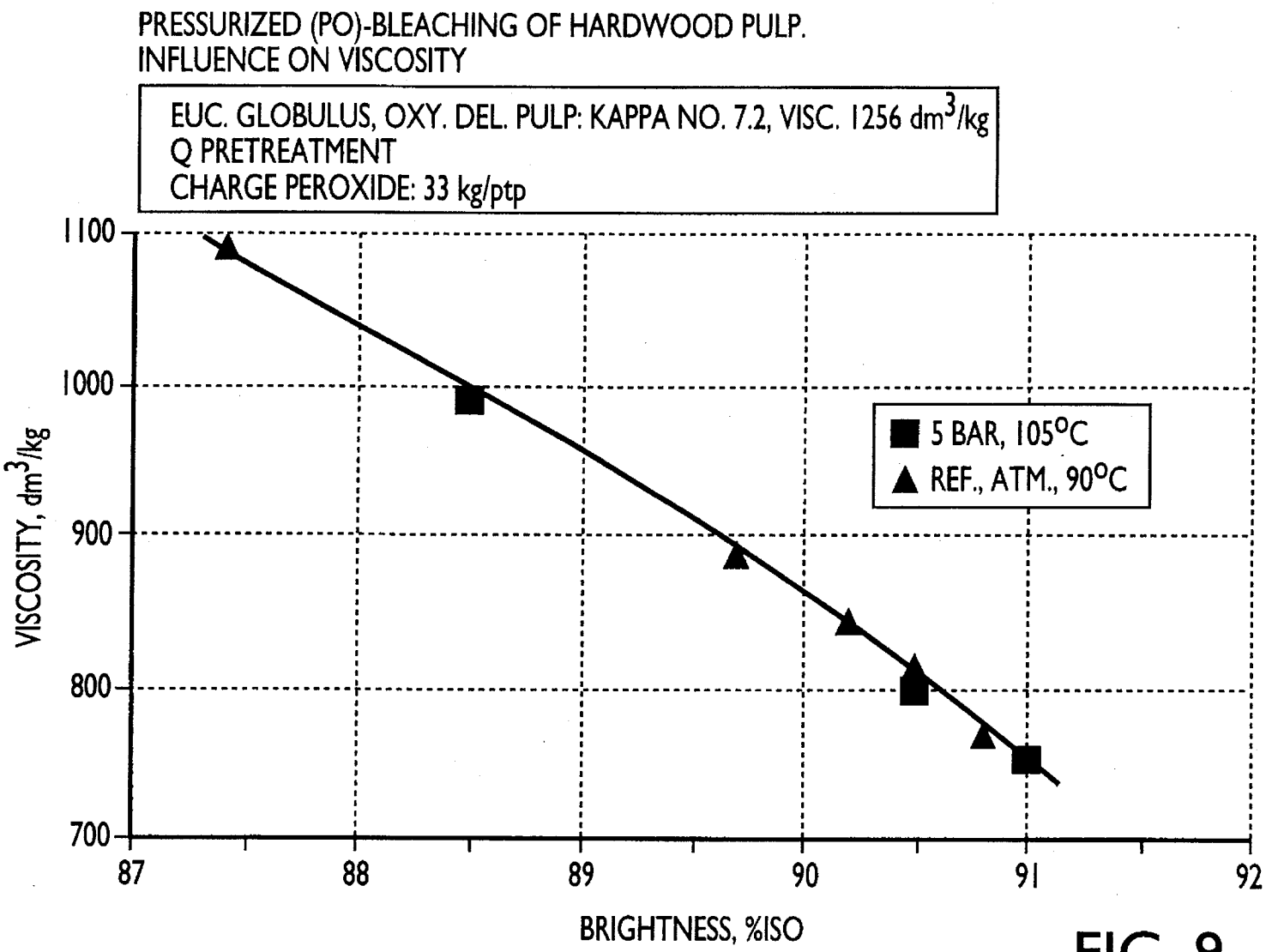
FIG. 9. shows a diagram of the relationship between brightness, % ISO, and viscosity, $dm^3/kg$, for a bleaching sequence in FIG. 8. according to the invention and a sequence for comparison at atmospheric pressure and 90° C.
Figure 10:
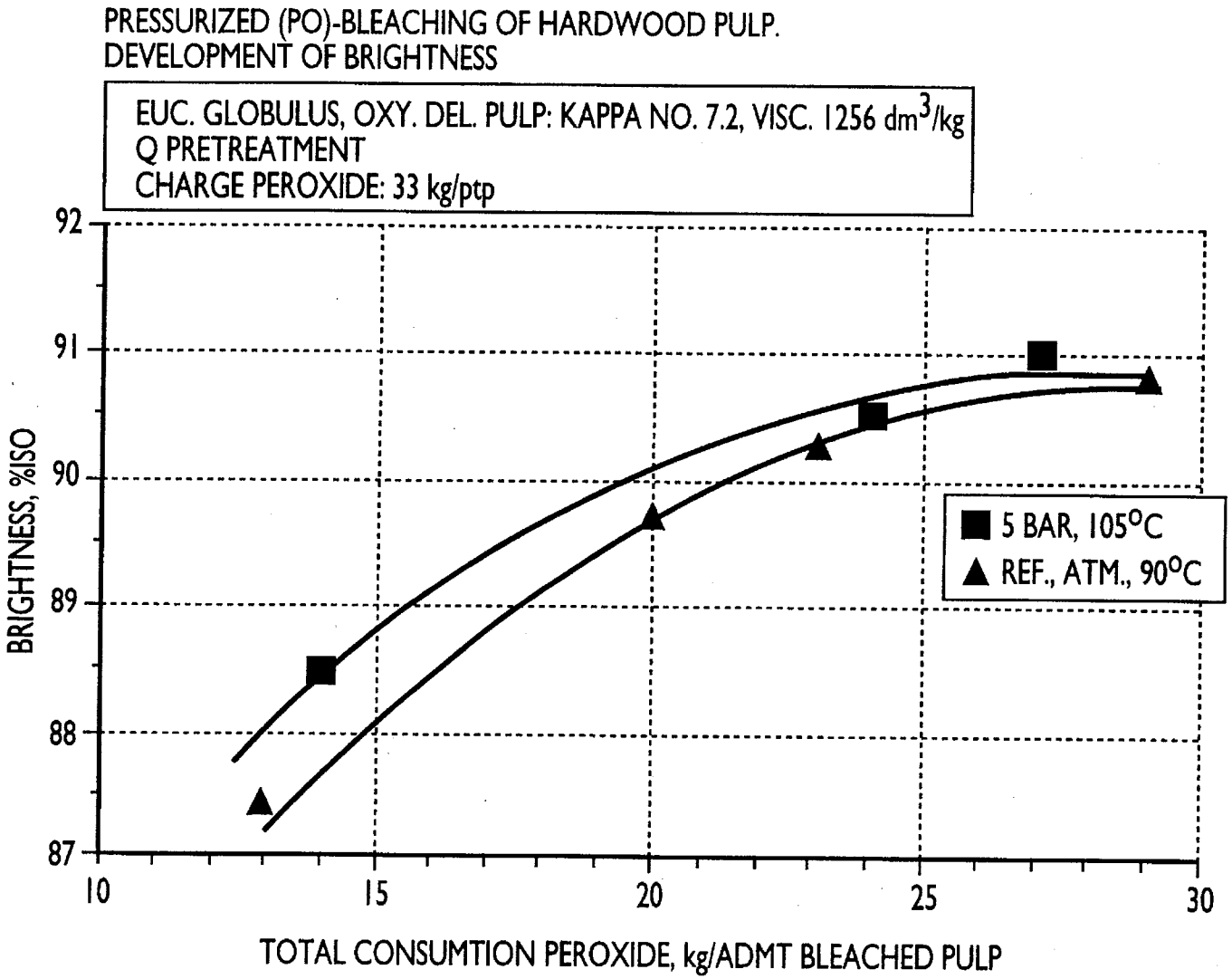
FIG. 10. shows a diagram of the relationship between brightness, % ISO, and total consumption of $H_2O_2$, kg/ADMT, for the bleaching sequence in FIG. 8. according to the invention and a sequence for comparison at atmospheric pressure and 90° C.

Comparative experiments have also been carried out (see FIGS. 8, 9 and 10) with regard to pressurised-(PO) bleaching of oxygen-delignified Euc. globulus, hardwood pulp, at 105° C., and bleaching of the same pulp under atmospheric pressure and at 90° C. The pulp having a kappa number of 7.2 was subjected to a preceding Q stage and the quantity of peroxide fed in was 33 kg/ptp.

Figure 11:
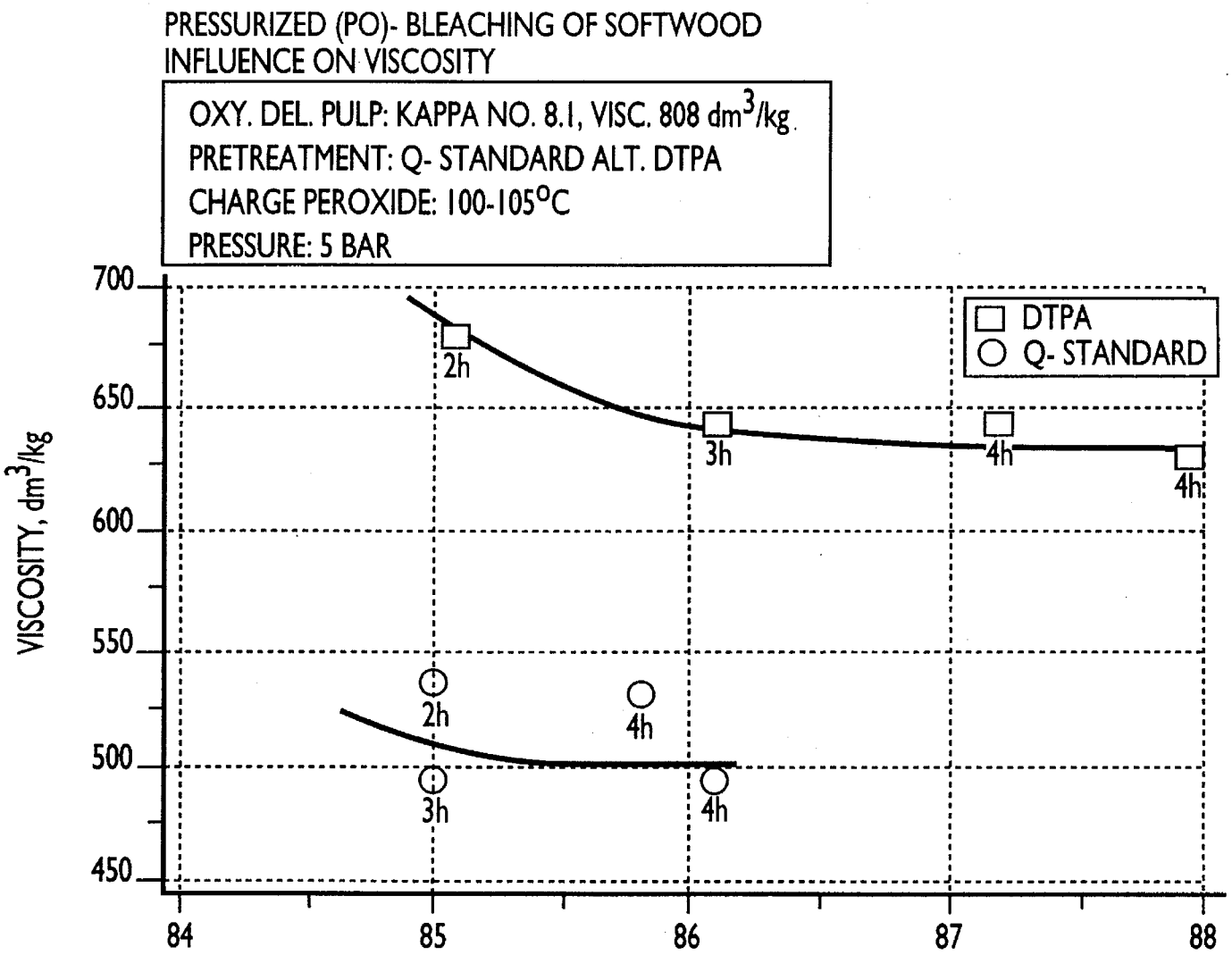
FIG. 11. Shows two diagrams of the relationship between brightness, % ISO, and viscosity, $dm^3/kg$, for pressurized (PO)-bleaching with either the standard Q pretreatment or the pretreatment using DTPA according to the invention. The first diagram shows bleaching of softwood the other one of softwood kraftpulp.

Comparative experiments have also been carried out (see FIG. 11) to show the influence on viscosity on two different softwood pulps in the pressurized (PO) stage bleaching from standard Q pretreatment and a pretreatment with DTPA, resp. One may not that the same brightness is reach in both cases in 3, resp. 4 hours and at the same viscosities.

Figure 12:
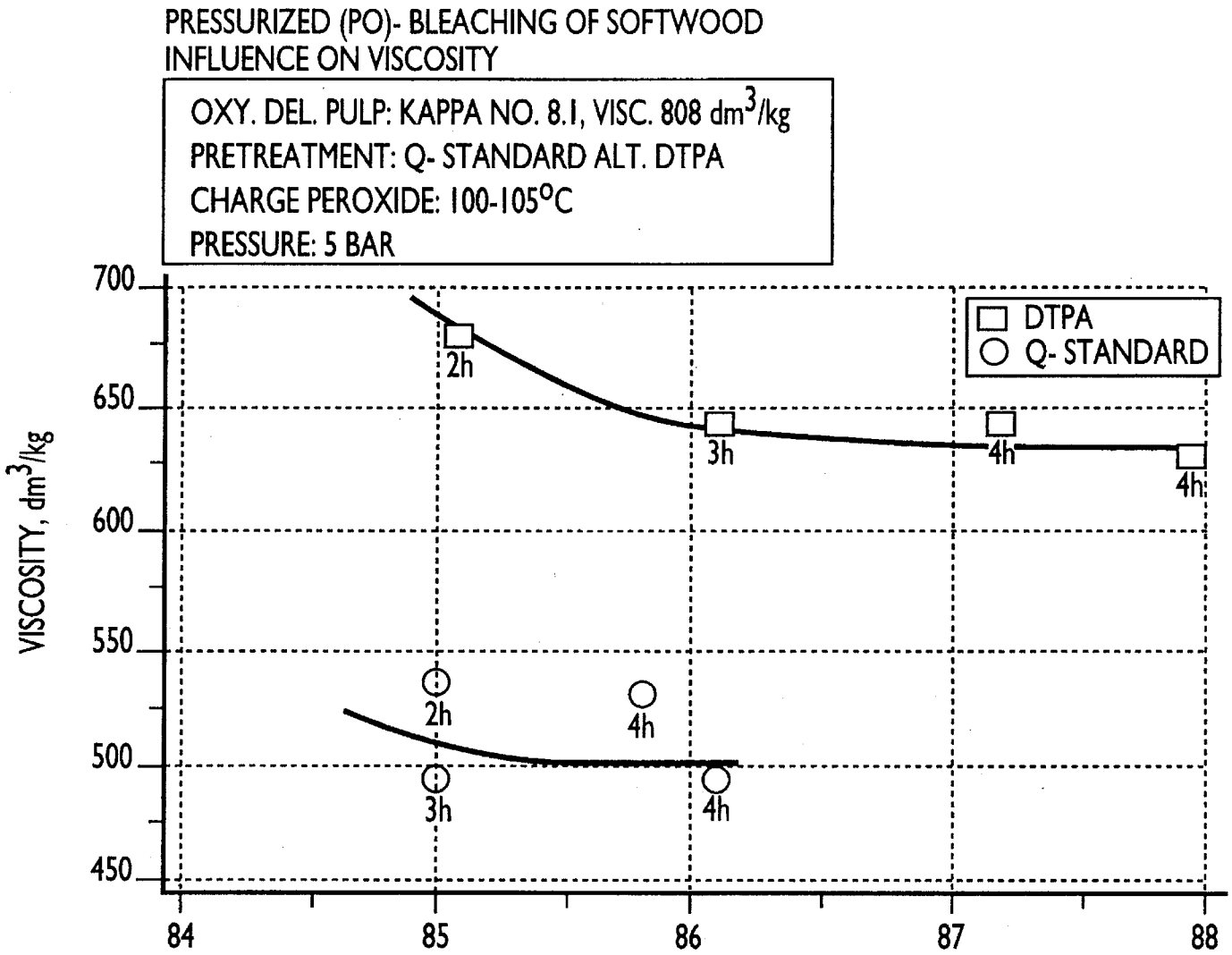
FIG. 12. shows a diagram of the influence of protectors (e.g. complexing agents) on the relationship between brightness, % ISO, and total consumption of $H_2O_2$, kg/ADMT, for a Q(PO)-bleaching of a lab. delignified pulp, and the relationship viscosity, $dm^3/kg$, to brightness, % ISO, for the same.
Figure 13:
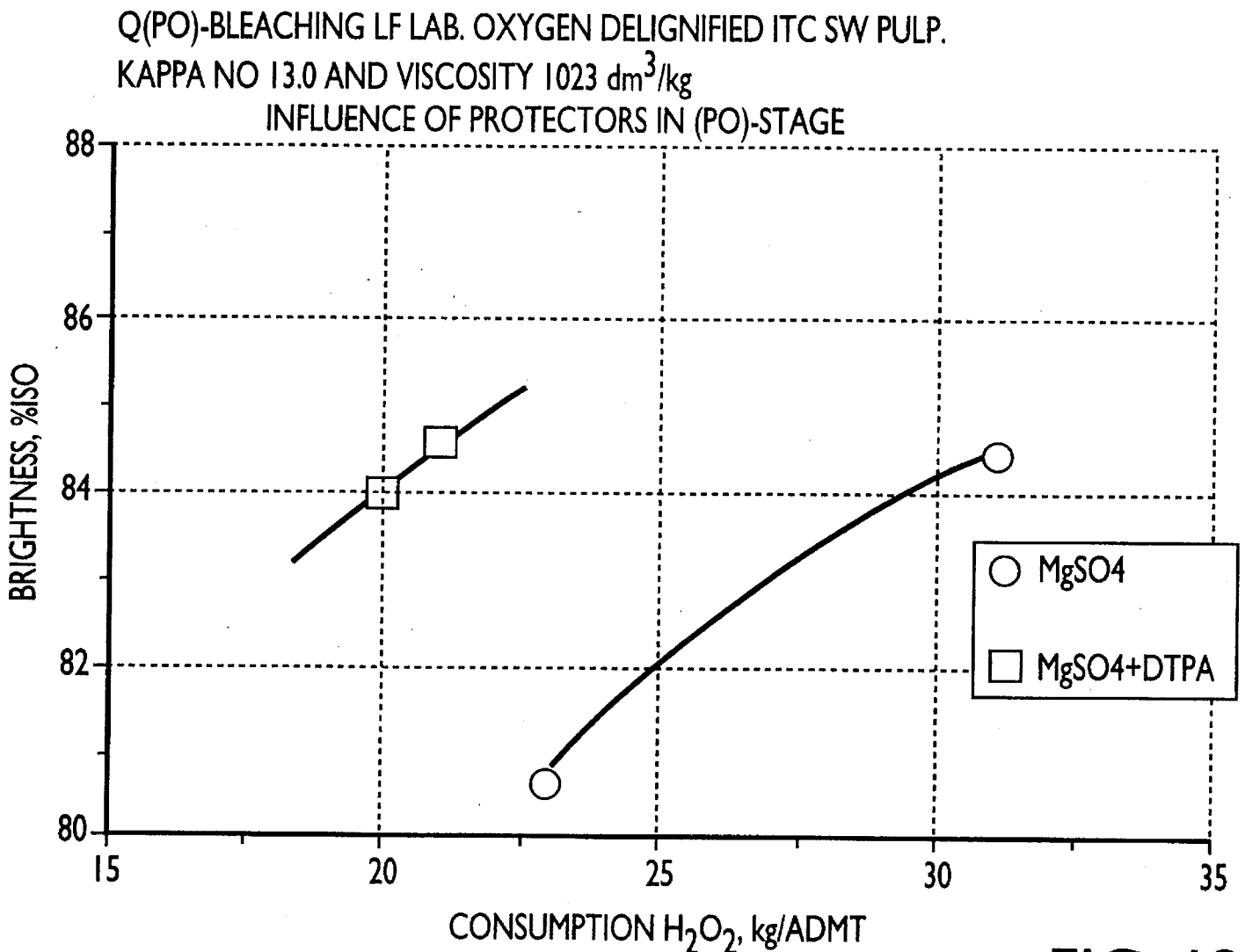
FIG. 13 shows a diagram of the influence of protectors on the relationship between hydrogen peroxide Consumption and Brightness, % ISO for a oxygen delignified Q(PO) bleached softwood pulp.
Figure 14:
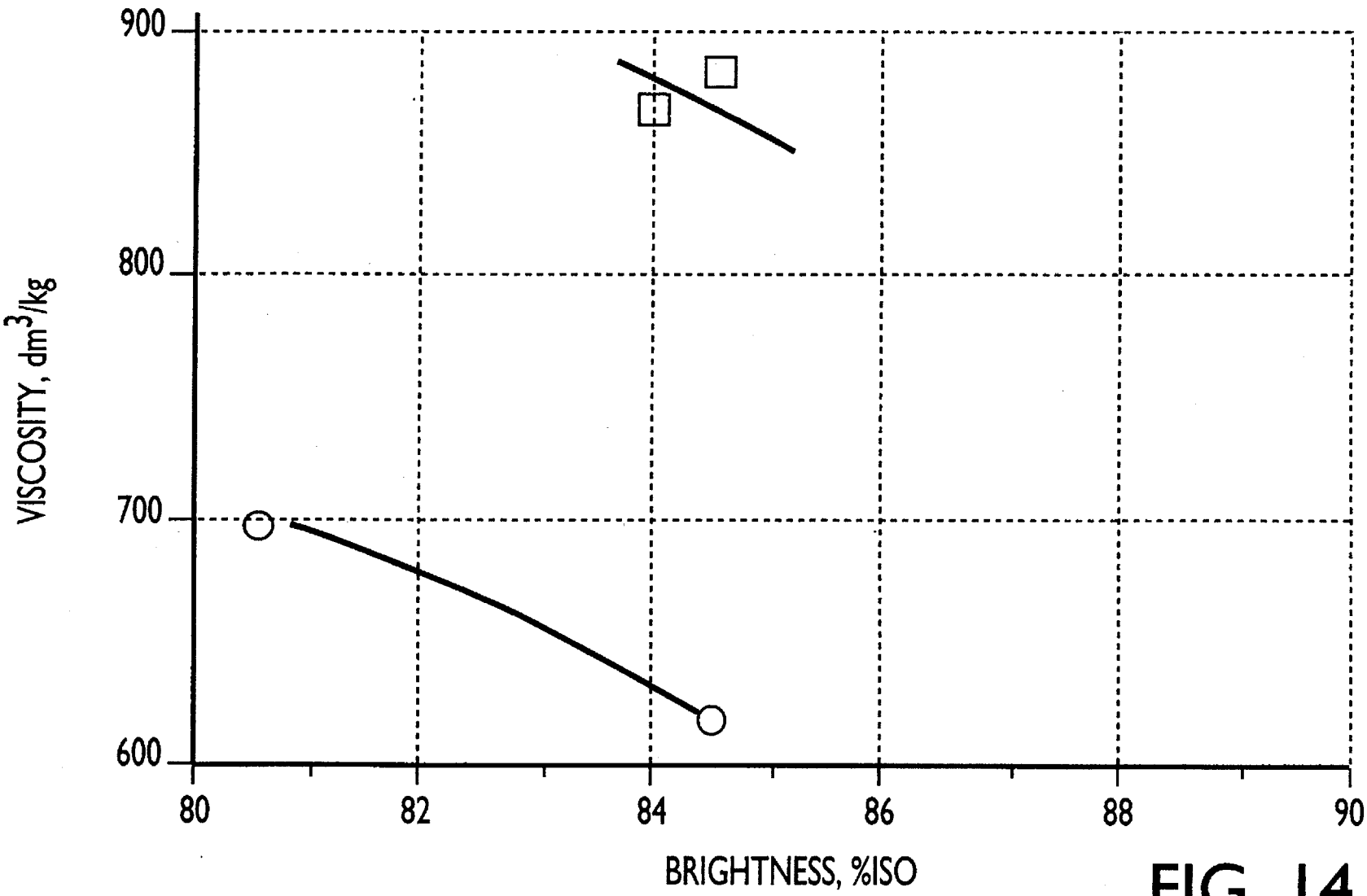
FIG. 14 shows a diagram of the relationship between Brightness, % ISO and Viscosity.

Comparative experiments have also been carried out (see FIG. 12) to show the influence on viscosity as related to brightness and the consumption of $H_2O_2$ as related to brightness for different combinations in the (PO) stage. In the first diagram one may note the decrease in consumption of the peroxide adding DTPA, as compared to the addition of $MgSO_4$ alone.

The diagram also shows that $MgSO_4$ has been used. To use Mg as well as Ca, alone or in combination, in the process in order to improve the quality of the pulp, is known to the skilled man.

In the diagram below on may note the beneficial effects on the viscosity at the same brightness using the combination as above.

The object of the invention is to achieve a high degree of utilisation of the peroxide employed and at the same time to achieve a high degree of brightness in the product. As we have found out, this can be affected separately by a number of measures.

The invention is not limited to that which has been described above, but the features which have been described can advantageously be combined within the scope of the attached patent claims.

We claim:

1. A process for chlorine-free bleaching of chemical pulp in association with the production thereof, where a suspension of the pulp has a consistency in a range of about between 8% to about 20% of cellulose-containing fibre material, comprising the steps of:

(a) treating the chemical pulp having a consistency of between 8% and 20% of cellulose-containing fibre material with at least one acid for adjusting the pH to a value below 7, (b) treating the pulp with a chelating agent, (c) pumping said pulp into at least one bleaching vessel by means of a medium consistency centrifugal pump to aid in pressurizing said bleaching vessel; and (d) bleaching the pulp in a liquid, non-gaseous state in at least one stage to a brightness exceeding 80% ISO with a peroxide, said peroxide employed in a quantity exceeding 5 kg/BDMT, wherein said bleaching with a peroxide occurs at a temperature above 100° C. and at a pressure exceeding 2 bar in at least one bleaching vessel having a cross-sectional area exceeding 3 $m^2$; and further wherein the exposed area of the interior surface of the bleaching vessel is metal and is not more than 4 $Vm^2$, where V equals the volume of the bleaching vessel in cubic meters.

2. The process according to claim 1 wherein during said peroxide bleaching step oxygen is added in a quantity which is less than 5 kg/BDMT.

3. The process according to claim 1 wherein the quantity of said peroxide employed exceeds 10 kg/BDMT and is less than 35 kg/BDMT.

4. The process according to claim 1 wherein the pressure exceeds 3 bar.

5. The process according to claim 1 wherein step (b) comprises (b1) treating the pulp with ozone to form an ozone-treated mixture;

(b2) treating said ozone-treated mixture with a chelating agent.

6. The process according to claim 5 wherein no washing occurs between step (b1) and step (b2).

7. The process according to claim 1 wherein during said bleaching a pH-elevating agent is added to said second mixture at a temperature which is less than 90° C. prior to addition of said peroxide.

8. The process according to claim 7 wherein upon addition of the pH-elevating agent the pH-value is raised to no higher than 11.5.

9. The process according to claim 1 wherein during said bleaching at least one complexing agent is added with the peroxide.

10. The process according to claim 9 wherein one of the at least one complexing agents substantially withstands a pH-value up to 11.

11. The process according to claim 9, wherein said one of the at least one complexing agent is diethylenetriaminepentaacetic acid.

12. The process according to claim 11, wherein diethylenetriaminepentaacetic acid is added in an amount between 1 and 2 kg diethylenetriaminepentaacetic acid/ADMT.

13. The process according to claim 1 wherein the manganese content in said pulp supplied to the peroxide stage is less than 5 g/BDMT of pulp.

14. The process according to claim 13, wherein the manganese content in said pulp is less than 1 g/BDMT of pulp.

15. The process according to claim 14, wherein the manganese content in said pulp is less than 0.05 g/BDMT of pulp.

16. The process according to claim 1, wherein said peroxide is hydrogen peroxide.

17. The process according to claim 1 wherein during said bleaching, oxygen is added in a quantity less than 3 kg/BDMT.

18. The process according to claim 17, wherein during said bleaching, oxygen is added in a quantity less than 1 kg/BDMT.

19. The process according to claim 1, wherein the temperature during said bleaching is between 100° C. and 105° C.

20. The process according to claim 1, wherein the pressure is 5 to 15 bar.

21. The process according to claim 20, wherein the pressure is 5 to 10 bar.

22. The process according to claim 1, wherein step (b) comprises (b1) treating the pulp with peracetic acid to form an peracetic acid-treated mixture;

(b2) treating said peracetic acid-treated mixture with a chelating agent.

23. The process according to claim 1, wherein step (b) comprises (b1) treating the pulp with an acid to form an acid-treated mixture;

(b2) treating said acid-treated mixture with ozone to form an ozone-treated mixture;

(b3) treating said ozone-treated mixture with a chelating agent.

24. The process according to claim 1, wherein step (b) comprises (b1)treating the pulp with an acid to form an acid-treated mixture;

(b2)treating said acid-treated mixture with peracetic acid to form a peracetic-treated mixture;

(b3)treating said peracetic-treated mixture with a chelating agent.

25. The process according to claim 8, wherein the pH-value is raised to a value between 10 and 11.

26. The process according to claim 1, wherein the diameter of the bleaching vessel exceeds 5 meters.

27. The process according to claim 26, wherein the diameter of the bleaching vessel exceeds 7 meters.

28. A process for chlorine-free bleaching of chemical pulp comprising the steps of:

(a) conveying said chemical pulp having a consistency of between 8%–20% of cellulose-containing fibre material into a bleaching line containing at least one bleaching vessel;

(b) pumping said pulp into said at least one bleaching vessel by means of a medium consistency centrifugal pump to aid in pressurizing said at least one bleaching vessel; and (c) bleaching said pulp in a liquid, non-gaseous state in at least one stage with a peroxide to a brightness exceeding 80% ISO said peroxide employed in a quantity exceeding 5 kg/BDMT at a temperature between 100° and 105° C. and at a pressure in the bleaching vessel exceeding two bar;

and further wherein the bleaching vessel has a cross-sectional area exceeding 3 $m^2$ and the interior surface of the vessel is metal and is no more than 4 $Vm^2$, where V equals the volume of the vessel in cubic meters;

and further wherein said pulp is bleached in a hydraulic state such that no substantial gas phase is present in the bleaching vessel;

and further wherein during said bleaching said chemical pulp does not substantially contact the interior surface of the bleaching vessel.

29. The process according to claim 28, wherein during said peroxide bleaching step oxygen is added in a quantity which is less than 5 kg/BDMT.

30. The process according to claim 29, wherein during said bleaching, a pH-elevating agent is added at a temperature which is less than 90° C. prior to addition of said peroxide.

31. The process according to claim 29, wherein during said bleaching at least one complexing agent is added with the peroxide.

32. The process according to claim 31, wherein said at least one complexing agent substantially withstands a pH-value up to 11.

33. The process according to claim 31, wherein said one complexing agent is DTPA.

34. The process according to claim 28, wherein said peroxide is hydrogen peroxide.

35. The process according to claim 28, wherein the pressure is 5 to 15 bar.

36. The process according to claim 28, wherein, prior to step (a), the pulp is treated with a chelating agent.

37. The process according to claim 36, wherein subsequent to the treatment with a chelating agent and prior to bleaching, the pulp is subjected to at least one process selected from the group consisting of washing and pressing.

38. The process according to claim 37, wherein, prior to said treatment with a chelating agent, the pulp is first treated with ozone and then subsequently treated with a chelating agent.

39. The process according to claim 37, wherein, prior to said treatment with a chelating agent, the pulp is treated with ozone.

40. The process according to claim 39, wherein subsequent to the treatment with ozone and prior to treatment with a chelating agent, the pulp is subjected to at least one process selected from the group consisting of washing and pressing.

41. The process according to claim 40, wherein prior to treatment with ozone, the pulp is treated with a chelating agent.

42. The process according to claim 41, wherein subsequent to the treatment with a chelating agent and prior to the treatment with ozone, the pulp is subjected to at least one process selected from the group consisting of washing and pressing.

43. The process according to claim 28, wherein, prior to step (a), the pulp is treated with ozone.

44. The process according to claim 43, wherein, prior to said treatment with ozone, the pulp is treated with a chelating agent.

45. The process according to claim 44, wherein subsequent to the treatment with a chelating agent and prior to treatment with ozone, the pulp is subjected to at least one process selected from the group consisting of washing and pressing.

46. A process for chlorine-free bleaching of chemical pulp in association with the production thereof, where a suspension of the pulp has a consistency in a range of about between 8% to about 20% of cellulose-containing fibre material, comprising the steps of:

(a) treating the chemical pulp having a consistency of between 8% and 20% of cellulose-containing fibre material with at least one acid for adjusting the pH to a value below 7, (b) treating the pulp with a chelating agent, (c) pumping said pulp into at least one bleaching vessel by means of a medium consistency centrifugal pump to aid in pressurizing said bleaching vessel; and (d) bleaching the pulp in a liquid, non-gaseous state in at least one stage to a brightness exceeding 80% ISO with a peroxide, said peroxide employed in a quantity exceeding 5 kg/BDMT, wherein said bleaching with a peroxide occurs at a temperature above 100° C. and at a pressure exceeding 2 bar in at least one bleaching vessel having a cross-sectional area exceeding 3 $m^2$; and further wherein the exposed area of the interior surface of the bleaching vessel is polymeric and is not more than 4 $Vm^2$, where V equals the volume of the bleaching vessel in cubic meters.

47. A process for chlorine-free bleaching of chemical pulp in association with the production thereof, where a suspension of the pulp has a consistency in a range of about between 8% to about 20% of cellulose-containing fibre material, comprising the steps of:

(a) treating the chemical pulp having a consistency of between 8% and 20% of cellulose-containing fibre material with at least one acid for adjusting the pH to a value below 7, (b) treating the pulp with a chelating agent, (c) pumping said pulp into at least one bleaching vessel by means of a medium consistency centrifugal pump to aid in pressurizing said bleaching vessel; and (d) bleaching the pulp in a liquid, non-gaseous statue in at least one stage to a brightness exceeding 80% ISO with a peroxide, said peroxide employed in a quantity exceeding 5 kg/BDMT, wherein said bleaching with a peroxide occurs at a temperature above 100° C. and at a pressure exceeding 2 bar in at least one bleaching vessel having a cross-sectional area exceeding 3 $m^2$; and further wherein the exposed area of the interior surface of the bleaching vessel is ceramic and is not more than 4 $Vm^2$, where V equals the volume of the bleaching vessel in cubic meters.

48. A process for chlorine-free bleaching of chemical pulp comprising the steps of:

(a) conveying said chemical pulp having a consistency of between 8%–20% of cellulose-containing fibre material into a bleaching line containing at least one bleaching vessel;

(b) pumping said pulp into said at least one bleaching vessel by means of a medium consistency centrifugal pump to aid in pressurizing said at least one bleaching vessel; and (c) bleaching said pulp in a liquid, non-gaseous state in at least one stage with a peroxide to a brightness exceeding 80% ISO said peroxide employed in a quantity exceeding 5 kg/BDMT at a temperature between 100° and 105° C. and at a pressure in the bleaching vessel exceeding two bar;

and further wherein the bleaching vessel has a cross-sectional area exceeding 3 $m^2$ and the interior surface of the vessel is polymeric and is no more than 4 $Vm^2$, where V equals the volume of the vessel in cubic meters;

and further wherein said pulp is bleached in a hydraulic state such that no substantial gas phase is present in the bleaching vessel;

and further wherein during said bleaching said chemical pulp does not substantially contact the interior surface of the bleaching vessel.

49. A process for chlorine-free bleaching of chemical pulp comprising the steps of:

(a) conveying said chemical pulp having a consistency of between 8%–20% of cellulose-containing fibre material into a bleaching line containing at least one bleaching vessel;

(b) pumping said pulp into said at least one bleaching vessel by means of a medium consistency centrifugal pump to aid in pressurizing said at least one bleaching vessel; and (c) bleaching said pulp in a liquid, non-gaseous state in at least one stage with a peroxide to a brightness exceeding 80% ISO said peroxide employed in a quantity exceeding 5 kg/BDMT at a temperature between 100° and 105° C. and at a pressure in the bleaching vessel exceeding two bar;

and further wherein the bleaching vessel has a cross-sectional area exceeding 3 $m^2$ and the interior surface of the vessel is ceramic and is no more than 4 $Vm^2$, where V equals the volume of the vessel in cubic meters;

and further wherein said pulp is bleached in a hydraulic state such that no substantial gas phase is present in the bleaching vessel;

and further wherein during said bleaching said chemical pulp does not substantially contact the interior surface of the bleaching vessel.

* * * * *